United States Patent [19]

Marino

[11] Patent Number: 4,754,261

[45] Date of Patent: Jun. 28, 1988

[54] SECURITY SYSTEM

[75] Inventor: Francis C. Marino, Dix Hills, N.Y.

[73] Assignee: Pittway Corporation, Syosset, N.Y.

[21] Appl. No.: 32,469

[22] Filed: Mar. 30, 1987

[51] Int. Cl.[4] ..... G08B 29/00

[52] U.S. Cl. ..... 340/514; 340/539; 340/515; 340/531; 455/67; 455/9; 455/154; 455/226

[58] Field of Search ..... 340/539, 514, 515, 531, 340/825.69, 825.72, 345, 825.54, 346, 505, 506, 511; 375/7, 8, 10; 455/67, 69, 84–86, 115, 78, 217, 226, 73, 53, 154, 157, 159

[56] References Cited

U.S. PATENT DOCUMENTS

| | | | |
|---|---|---|---|
| 3,348,666 | 9/1982 | Ogita | 455/159 |
| 3,435,444 | 3/1969 | Kuhn | 340/539 |
| 3,768,018 | 10/1973 | Deming | 340/696 |
| 3,925,763 | 12/1975 | Wadhwani | 340/539 |
| 4,024,519 | 5/1977 | Galvin | 340/514 |
| 4,032,909 | 6/1977 | Boyce | 340/514 |
| 4,361,904 | 11/1982 | Matsumura | 455/115 |
| 4,491,968 | 1/1985 | Shimp | 455/9 |
| 4,506,332 | 3/1985 | Bloch | 455/226 |
| 4,603,325 | 7/1986 | Marino | 340/539 |

FOREIGN PATENT DOCUMENTS

| | | | |
|---|---|---|---|
| 0069470 | 1/1983 | European Pat. Off. | 340/310 |

*Primary Examiner*—Donnie L. Crosland

[57] ABSTRACT

Methods and apparatus for evaluating installation of components of a wireless type of alarm system or the like that includes a plurality of satellite stations, each of which includes a sensor and associated transmitter circuitry responsive to the sensor for transmitting an alarm signal and a central station for receiving the alarm signal and operating an output device in response to the received signal. The system includes alarm signal processing circuitry that has a first (normal) mode for processing the received signal and second (installation) mode in which a characteristic of the received alarm signal is impaired so that a received signal of greater quality than in normal mode is required to operate the output device.

17 Claims, 1 Drawing Sheet

SECURITY SYSTEM

This invention relates to security systems and the like, and more particularly to methods and apparatus for evaluating installation of components of such systems.

Typical security systems include a central monitoring station and a plurality of satellite monitoring devices, for example, smoke sensors, heat sensors, window sensors and/or intrusion sensors that monitor sensitive locations within a general area of surveillance.

In security systems, it is frequently desirable to transmit signals warning against impending danger from the satellite monitoring devices to a central monitoring station or panel. For example, a house security system may monitor a plurality of satellite sensors which can generate signals indicating alarm conditions (for example, smoke, fire, unauthorized entry through a door or window, loss of power, etc.). When that surveillance area comprises a large building, or even an entire complex, the monitoring devices may be located at substantial distances from one another and from the central station or panel. A change of state of a sensor causes its associated satellite transmitter to generate an alarm signal identifying the sensor and the type of condition producing the alarm signal. The central station receives and decodes the signal transmitted from the satellite sensor/transmitter unit, and generates an output signal which alerts the system operator to the occurrence of the alarm condition, for example, by displaying information which identifies the remote sensor signaling the alarm condition and the type of alarm condition indicated by that remote sensor. Security systems of those types may be of the wire or wireless type.

Advantages of the wireless type over the wire type systems includes reductions in both complexity and cost of installation. However, advantages of wireless type systems can be offset by improper location of the satellite transmitter devices relative to the central station receiver as RF (radio frequency) signals are both absorbed and reflected by materials of the type commonly used in building construction. Also, large metallic objects such as refrigerators, washing machines, clothes dryers, air conditioners, hot and cold air duct work, etc., will reflect or alter the otherwise direct RF signal path between the satellite transmitter and the central receiver. An unskilled installer can easily install the transmitting device in a location which results in marginal or distorted signal transmission path to the central receiver. The reduced complexity of installation of wireless systems has attracted relatively unskilled personnel into the security system installation market, and particularly that segment of the market providing fire, burglary and or personal emergency protection for the homeowner. Where a satellite transmitter device is located in a marginal signal transmission path, the device may appear to be communicating with the central receiver at the time of installation, but the communication may fail when temperature or humidity conditions or other factors change the transmission or reception characteristics of the system device within its specified tolerances.

In accordance with the invention, there is provided methods and apparatus for evaluating installation of components of an alarm system that includes a plurality of satellite stations, each of which includes a sensor and associated transmitter circuitry responsive to the sensor for transmitting an alarm signal and a central station for receiving the alarm signal and operating an output device in response to the received signal. The system includes alarm signal processing circuitry that has a first (normal) mode for processing the received signal and second (installation) mode in which a characteristic of the received alarm signal is impaired so that a received signal of greater quality than in normal mode is required to operate the output device. An installer in using the system places the processing circuitry in the second (installation) mode, positions a sensor in an area to be monitored, and actuates the sensor to cause it to transmit an alarm signal. The signal processing circuitry operates the output device in response to satisfactory evaluation by the processor of the impaired received signal. In the absence of an output, the installer repositions the sensor and actuates the repositioned sensor to cause it to again transmit an alarm signal. The process is repeated until the output device signals satisfactory evaluation. After satisfactory installation of one or more sensors is completed, the alarm signal impairment is removed for normal system operation.

In a particular embodiment, the central station includes demodulation circuitry for converting a transmitted RF signal to a pulse coded signal, a processor for decoding the received pulse code signal, and generating an output which identifies the sensor and the type of condition that produced the alarm signal, and the signal impairment circuitry is connected in circuit between the demodulator and the decoder. A control console that produces an output in installation mode switches the signal impairment circuitry to a reduced processing condition and the decoder will acknowledge satisfactory transmission of an alarm signal only if the impaired decoded signal is not distorted beyond acceptable limits, thus enabling evaluation of either or both for the quality of the received signal and the quality of the RF transmission path between the transmitter and the central receiver. In order for the processor to satisfactorily act on the demodulated signals, the received signal must be of sufficient field strength (signal amplitude) to be properly processed by the RF receiver circuits so that the original pulse code signal sent by the remote transmitter can be reconstructed within distortion limits recognizable by the processor's decoding circuitry.

In a particular security system embodiment, UHF (345 megahertz) transmitter and receiving equipment are employed and the signal impairment circuitry includes a linear amplifier whose gain is reduced in the test mode. In another embodiment, the clipping level of a shaping circuit is similarly altered in the test mode.

Other features and advantages of the invention will be seen as the following description of a particular embodiment progresses, in conjunction with the drawings, in which.

DESCRIPTION OF PARTICULAR EMBODIMENT

Figure 1:
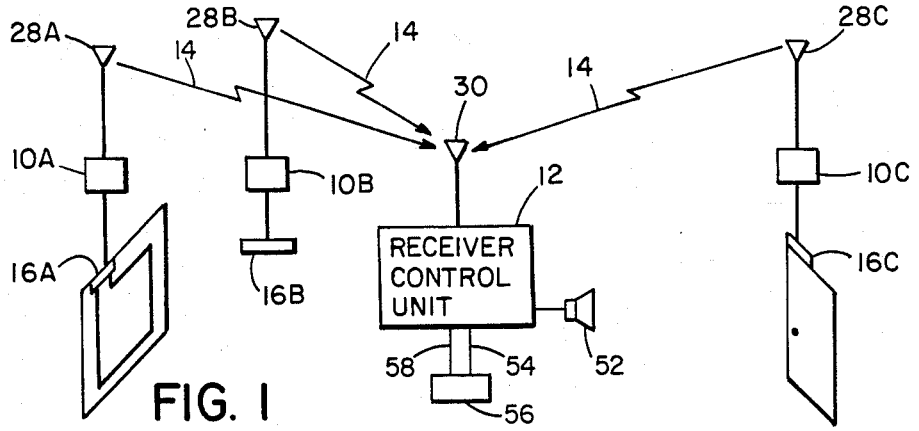
FIG. 1 is a block diagram of a wireless security system in accordance with the invention.
Figure 2:
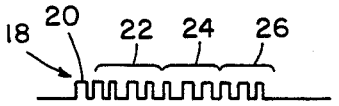
FIG. 2 is a diagram indicating the nature of the code alarm signal.
Figure 3:
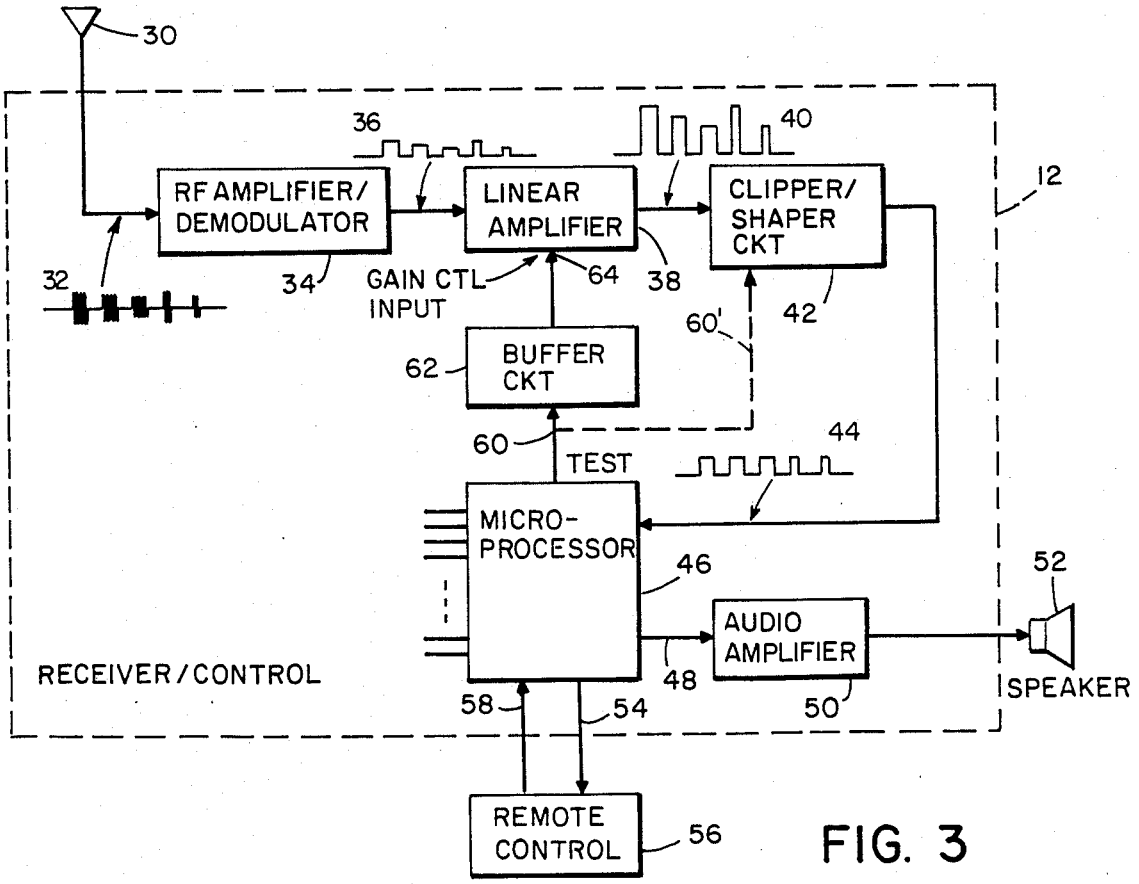
FIG. 3 is a block diagram of receiver controller circuitry employed in the system of FIG. 1.

The security system shown in FIG. 1 includes plurality of satellite transmitter units 10 and a central receiver-decoder unit 12, transmitter units 10 and receiver decoder unit 12 being interconnected by high frequency (345 megahertz) radio links 14. Associated with each transmitter unit 10 is a security device 16 (for example, a window monitor 16A, an intrusion sensor 16B, a door monitor 16C) that is uniquely identified by a multibit device code. Each transmitter unit 10, in response to a trigger signal from its sensor, generates a serial train of signals in the form shown at 18 in FIG. 2, including a sync pulse 20, a group 22 of system code pulses (to distinguish between its signal transmission and signal transmissions from possible other neighboring security systems, a group 24 of sensor code pulses which identify the particular sensor (each security system in a particular embodiment being arranged to monitor up to thirty-two security devices 16), and a group 26 of status pulses (which identify the status of the sensor—an alarm condition, for example). The circuity of each transmitter 10 generates the serial train 18 of coded pulses which modulate a 345 megahertz signal from an RF oscillator and the resulting pulse width modulated RF signal is supplied to associated transmitter antenna 28.

The receiver decoder unit 12 includes antenna 30 that receives the RF signal 32 and applies it to RF amplifier/demodulator unit 34 where the received signal is demodulated to provide a received pulse code train 36 which is applied to linear amplifier 38. The output 40 of amplifier 38 is passed through a clipping and signal shaping circuit 42 to produce signal 44 which is applied to processor 46. Processor 46 decodes the pulse train 44 as a function of the width of each of the pulse signals (similar to the system disclosed in European Patent Publication No. 69,470, the disclosure of which is incorporated herein by reference). If the signal train 44 is an alarm signal that is not distorted beyond acceptable limits, processor 46 provides an output signal on line 48 through audio amplifier 50 to speaker 52 (and over output line 54 to remote console 56) to indicate the existence and source of the alarm condition.

Processor 46 may be placed in an installation [test] mode via a keyed command from console 56 over line 58, so that the processor output on line 60 changes from logic level 0 to logic level 1. The logic signal on line 60 is applied through buffer circuit 62 to linear amplifier 38 and reduces the gain of that amplifier by a predetermined factor. For example, if the gain of amplifier 38 is reduced in half, this has the effect of reducing the overall sensitivity of the RF circuits by minus 6 dB. This, in turn, reduces the effective range of the transmitter/-receiver combination in half, allowing a 6 dB margin of the established transmission path from the transmitter 10 to the receiver 12, when processor 46 is switched out of test mode and full gain is restored to the linear amplifier 38. (Alternatively, the clipping level of shaping circuit 42, rather than the gain of amplifier 38, may be proportionally increased under the control of a signal on dotted line 60' with similar effects.)

While the processor is in TEST mode, if the signal 44 is not distorted beyond acceptable limits, processor 46 provides an acknowledgement on line 48 which is applied through audio amplifier 50 to speaker 52 to generate a sound that is loud enough to be heard by the installer.

Thus, the installer may secure a transmitter in a desired location and, in response to operation of the installed sensor, control 12 will generate an audible acknowledgement that an acceptable communication link has been established. When the test mode is terminated by a key input to console 56, the effective range between each installed transmitter 10 and receiver 12 is automatically increased by the predetermined factor, thus providing a margin for possible future deterioration of the RF propagation path.

The invention thus provides a simple built in acknowledgement for the installer which automatically provides a predetermined safety margin of the transmission path established without need for the installer to be aware that such margin has been provided. The test mode determines that the code signal transmission path not only meets field strength requirements, but demodulated signal distortion limits as well, and no additional installation equipment is required by the installer to establish reliable RF propagation paths.

While a particular embodiment of the invention has been shown and described, various modifications will be apparent to those skilled in art, and therefore it is not intended that the invention be limited to the disclosed embodiment, or to details thereof, and departures may be made therefrom within the spirit and scope of the invention.

What is claimed is:

1. An alarm system comprising a plurality of satellite stations, each of which includes a sensor and associated transmitter circuitry responsive to the sensor for transmitting an alarm signal, central station apparatus remote from said satellite stations for receiving the alarm signal and operating an output device in response to the received alarm signal, means for modifying the received alarm signal, processor means for evaluating the received alarm signal and producing an output signal in response thereto, test mode control means, means responsive to said test mode control means for placing said signal modifying circuitry in a test mode to reduce the effective range of the transmitter receiver combination, and means operative in said test mode and responsive to said evaluation apparatus for producing an output signal in response to satisfactory evaluation of the received alarm signal.

2. The system of claim 1 wherein said signal modifying circuitry includes an amplifier and said means responsive to said test mode control means is operative to reduce the gain of said amplifier in said test mode.

3. The system of claim 1 wherein said signal modifying circuitry includes a clipping circuit and said means responsive to said test mode control means is operative to alter the clipping level of said clipping circuit in said test mode.

4. The system of claim 1 wherein said means operative in the test mode produces an audible output signal in response to satisfactory evaluation of the received signal by said evaluation apparatus.

5. The system of claim 1 wherein said test mode control means further includes means for rendering said output signal producing means operative in the test mode.

6. The system of claim 1 wherein said system is of the wireless type, said associated transmitter circuitry transmits an alarm signal at radio frequency, and said central station apparatus includes demodulation apparatus for providing a demodulated signal in response to the RF alarm signal received at the receiver antenna.

7. The system of claim 6 wherein said signal modifying circuitry includes an amplifier and said means responsive to said test mode control means is operative to reduce the gain of said amplifier in said test mode.

8. The system of claim 6 wherein said signal modifying circuitry includes a clipping circuit and said means responsive to said test mode control means is operative to increase the clipping level of said clipping circuit in said test mode.

9. The system of claim 7 wherein said test mode control means further includes means for rendering said output signal producing means operative in the test mode to produce an output signal in response to satisfactory evaluation of the received signal by said evaluation apparatus.

10. The system of claim 9 wherein said means operative in the test mode produces an audible output signal.

11. For use in an alarm system that includes a plurality of satellite stations, each of which includes a sensor and associated transmitter circuitry responsive to the sensor for transmitting an alarm signal, and central station apparatus remote from said satellite stations for receiving the alarm signal and operating an output device in response to the received alarm signal, said central station apparatus including processor means for evaluation of the received signal and producing an output signal in response thereto, an installation method comprising the steps of positioning a sensor in an area to be monitored, actuating said sensor to cause its satellite station transmitter circuitry to transmit an alarm signal, impairing the alarm signal received by said central station to enable evaluation of the quality of the received signal and the quality of the transmission path between the transmitter and the central station, producing an output signal in response to satisfactory evaluation by said processor means of said impaired received signal, repositioning said sensor in said area to be monitored in the absence of said output signal, actuating said repositioned sensor to cause its satellite station transmitter circuitry to transmit an alarm signal, and removing the alarm signal impairment for normal system operation.

12. The method of claim 11 wherein said system is of the wireless type, said associated transmitter circuitry transmits an alarm signal at radio frequency, and said central station apparatus includes demodulation apparatus for providing a demodulated signal in response to the received RF alarm signal.

13. The method of claim 11 wherein said central station apparatus includes an amplifier and said alarm signal is impaired by reducing the gain of said amplifier in said test mode.

14. The method of claim 11 wherein said central station apparatus includes a clipping circuit and said alarm signal is impaired by increasing the clipping level of said clipping circuit in said test mode.

15. The method of claim 11 and further including the step of rendering said output signal producing means operative in the test mode to produce an output signal in response to satisfactory evaluation of the received signal by said processor means.

16. The method of claim 12 wherein said processsor means determines that the selected signal transmission path meets field strength requirements and demodulated signal distortion limits, and said installer removes said alarm signal impairment for normal system operation in response to satisfactory evaluation of the received signal by said processor means.

17. The method of claim 16 wherein said output signal producing means produces an audible output signal and is rendered operative in said test mode.

* * * * *